US005119843A

United States Patent [19]

Keenan

[11] Patent Number: 5,119,843

[45] Date of Patent: Jun. 9, 1992

[54] VACUUM HOSE STORAGE AND ACCESS APPARATUS

[76] Inventor: Vaughn E. Keenan, 4316 - 53 Street N.E., Calgary, Alberta T1Y 4B3, Canada

[21] Appl. No.: 751,529

[22] Filed: Aug. 29, 1991

[51] Int. Cl.[5] ..... B65H 75/34

[52] U.S. Cl. ..... 137/355.23; 137/355; 137/26; 242/86

[58] Field of Search ..... 137/355.26, 355.16, 137/355.2, 355.23; 242/86

[56] References Cited

U.S. PATENT DOCUMENTS

| | | | |
|---|---|---|---|
| 2,595,655 | 5/1952 | Hannay | 137/355.2 |
| 2,606,067 | 8/1952 | Roark | 137/355.2 |
| 2,935,080 | 5/1960 | Kilmek | 137/355.23 |
| 3,464,859 | 9/1969 | Hamrick | 137/355.23 |
| 3,822,719 | 7/1974 | Nederman | 137/355.26 |
| 3,911,944 | 10/1975 | Hukuba et al. | 137/355.2 |
| 4,534,384 | 8/1985 | Graham et al. | 137/355.26 |

FOREIGN PATENT DOCUMENTS

| | | | |
|---|---|---|---|
| 18396 | of 1897 | United Kingdom | 137/355.20 |

*Primary Examiner*—A. Michael Chambers

[57] ABSTRACT

Permanently installed vacuum system hose is stored on a hose reel device that includes a retraction spring and a hose guide mechanism that ensures the hose is placed in a tight, space efficient pattern of one or two rows of hose. This efficient storage pattern is accomplished without operator effort. A ratchet mechanism allows hose to be drawn off the reel on demand. When the ratchet is disengaged, the vacuum hose is drawn back onto the reel.

6 Claims, 2 Drawing Sheets

VACUUM HOSE STORAGE AND ACCESS APPARATUS

BACKGROUND OF THE INVENTION

This invention relates to flexible vacuum hose storage devices, and more particularly to a novel hose reel and guide apparatus for commercial vacuum hose normally used in conjunction with permanently installed vacuum systems which are used primarily for cleaning floors.

The current common method of storing flexible vacuum hose for permanently installed vacuum systems is to coil the hose by hand and to hang it on a large hook or hanger that is fastened to a wall. Many variations of vacuum hose hooks or hangers are available, but all serve the same basic function.

The disadvantages of this prior art relate to the amount of effort required to manually coil and uncoil a relatively long hose before and after using it, as well as the amount of space that the vacuum hose takes up when it is stored in this manner.

Another disadvantage of the prior art is that twists are introduced in a hose that is manually coiled and uncoiled. Most types of commercial spiral-ribbed vacuum hose are inflexible to twisting torque in the plane of the spiral ribs. The 360 degree twist that is introduced with each manual coil cannot be absorbed by the hose, and thus causes the uncoiled section of hose to twist, kink, and tangle. The end of the hose is normally an angled pipe section for attaching to a vacuum wand or vacuum implements. The manual coiling twisting torque can cause this hose end section to be spun around, possibly damaging walls or furniture.

It is the principal object of the present invention to provide a convenient and space efficient apparatus for storing and accessing standard commercial vacuum hose used in conjunction with permanently installed vacuum cleaning equipment.

More specifically, the object is to provide a means for retracting and guiding vacuum hose onto a reel in an efficient pattern that ensures full and even use of the reel space in either a single hose layer or a double hose layer configuration.

SUMMARY OF THE INVENTION

In accordance with the foregoing objects, the invention contemplates a vacuum hose and reel apparatus consisting of a chassis, a reel, a reel ratchet mechanism, a hose guide mechanism, and a means for applying a retraction torque to the reel in the direction of winding vacuum hose onto the reel.

The vacuum hose storage and access apparatus can be connected to a permanently installed vacuum system through a short hose or pipe that plugs into a standard vacuum outlet at one end, and enters the chassis along the axis of rotation of the reel at the other end. A sealed rotary coupling allows a vacuum to be maintained across the boundary of the stationary chassis and the rotating reel. One end of the main vacuum hose attaches to the rotary coupling inside the drum cavity of the reel. The hose runs the length of the drum cavity. At the far end of the cavity, the hose is bent and formed to pass to the outside drum surface and wind onto the reel.

The main vacuum hose passes through a hose guide block as it is wound on and off the reel. The hose guide block travels along hose guide rails parallel to the axis of the reel. The hose guide block ensures that the vacuum hose is laid onto the reel in a tight spiral pattern that optimizes the available reel space and ensures the apparatus does not get jammed by multiple overlapped layers of vacuum hose. The position of the hose guide block on the hose guide rails is controlled by a rope assembly and spool. A constant force spring provides a biasing force on the hose guide block against the direction of pull by the rope. One end of the rope attaches to the hose guide block. The rope runs parallel to the hose guide to the rim of the reel, and then changes direction toward the axis of the reel by passing through a pulley. The other end of the rope is attached to a spool which forms the axle of the reel. As the reel turns, rope is wound on or off the spool causing the hose guide block to track across the reel.

When engaged, the reel ratchet mechanism allows hose to be drawn off the reel against the retraction torque, but prevents the hose from being taken up immediately when the extraction pulling force is removed. This allows the invention operator to pull out as much working vacuum hose as needed without having it all pulled back onto the reel immediately. When the operator wants to put away the hose or shorten the length of working hose, the ratchet is disengaged and the hose is taken up by the retraction torque.

The means for applying the retraction torque could be a spring or springs, an electric motor or a vacuum powered motor, a hand crank or a combination of more than one of these sources. In the disclosed embodiment the retraction torque is provided by a parallel drum spring.

DESCRIPTION OF PREFERRED EMBODIMENT

Figure 1:
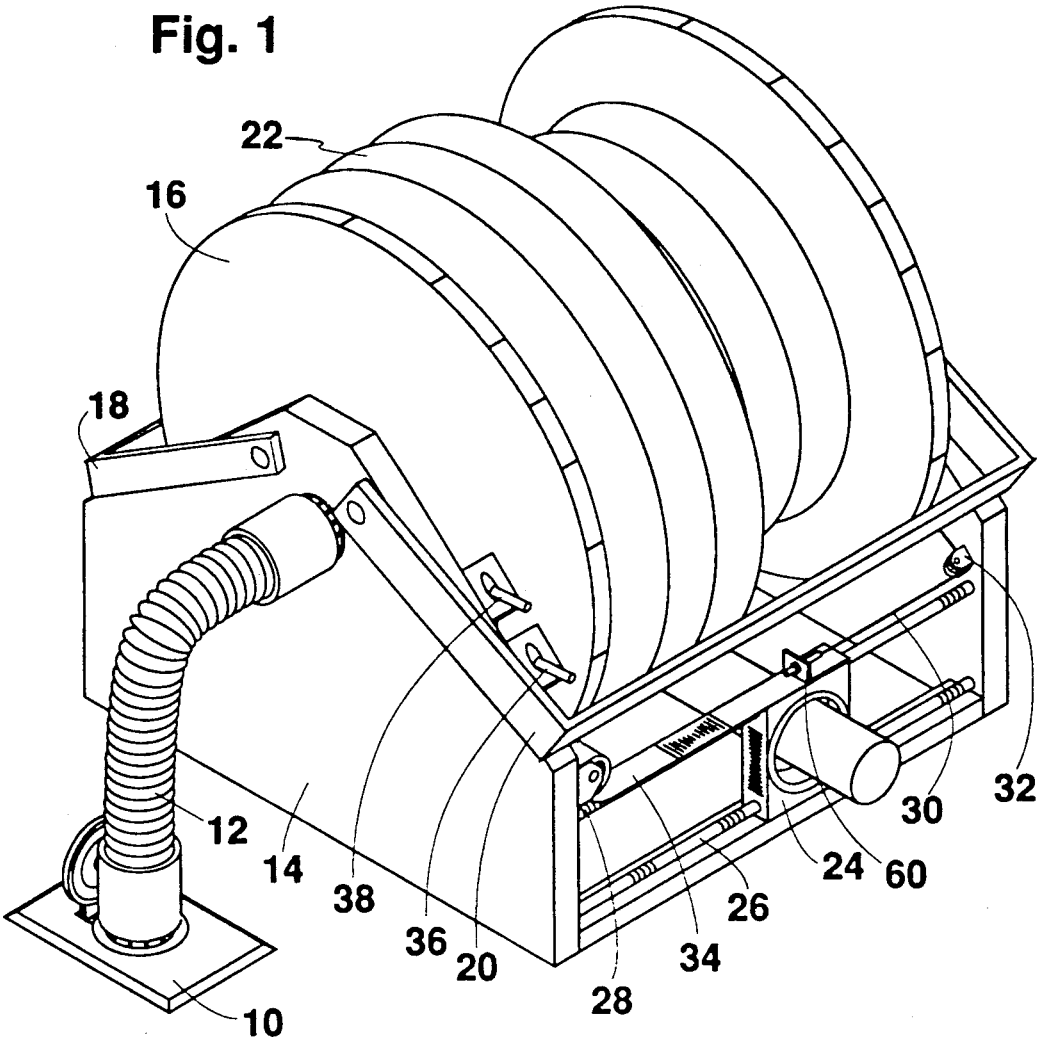
FIG. 1 is a perspective view of a vacuum hose storage and retrieval apparatus embodying the present invention.

Referring now to the drawings, FIG. 1 shows connecting hose 12 attaching the chassis 14 to a permanently installed vacuum system outlet 10. Connecting hose 12 can be unplugged from either or both connections to enhance the portability of the apparatus. Handles 18 and 20 are shown in their normal resting position and can be folded up for carrying. Vacuum hose 22 passes through the hose guide block 24 when it is wound on or off reel 16. Hose guide block 24 slides along upper and lower hose guide rails 28 and 26. Rope assembly 30 passes through pulley 32 and is attached to hose guide block 24 at angle bracket 60. Constant force flat spring 34 applies the biasing force to hose guide block 24 to keep rope assembly 30 taunt. Ratchet release switch 36 and vacuum motor power switch 38 are mounted to chassis 14.

Figure 2:
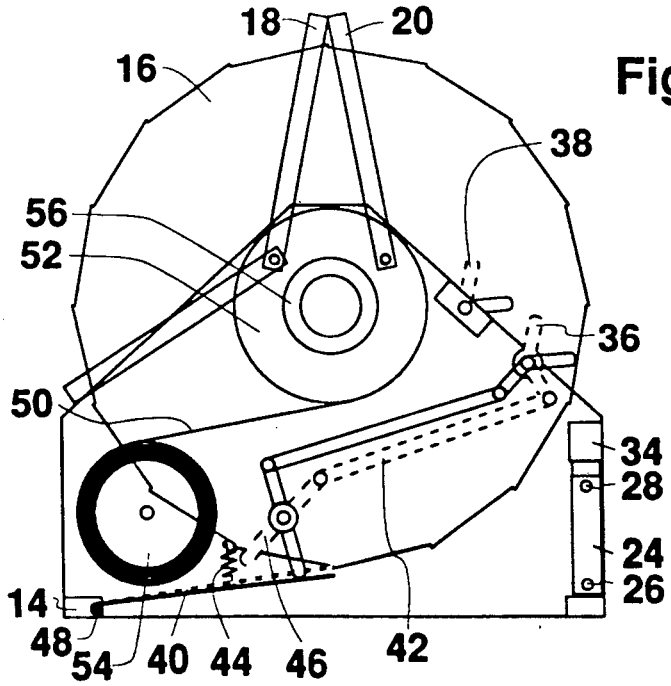
FIG. 2 is a side elevation cut-away view of portions of the apparatus of FIG. 1.

Referring now to FIG. 2, parallel drum spring 50 uses storage drum 54 and applies approximately 1.25 foot-pounds, of torque to output drum 52 which is attached to, and concentric with the axis of rotation of reel 16. The torque created by parallel drum spring 50 is approximately constant over the full number of turns of reel 16.

A ratchet mechanism is utilized to allow one-way rotation of reel 16 while the vacuum hose is in active use. When engaged, the ratchet mechanism allows a working length of hose to be extracted from the reel, and at any time, that working length can be increased by simply pulling more hose, until the hose is fully unwound from the reel. The ratchet dog 40 pivots on pin 48 which is attached to the chassis 14. Spring 44 applies a force on the ratchet dog 40 toward the ratchet gear which is the outer rim edge of the reel 16. The dog release actuator 46 is connected through linkage 42 to the ratchet release switch 36. Both the engaged and disengaged positions are shown.

Handles 18 and 20 are shown in outline form. Handle 18 is shown in both the in-active and in-use position.

Figure 3:
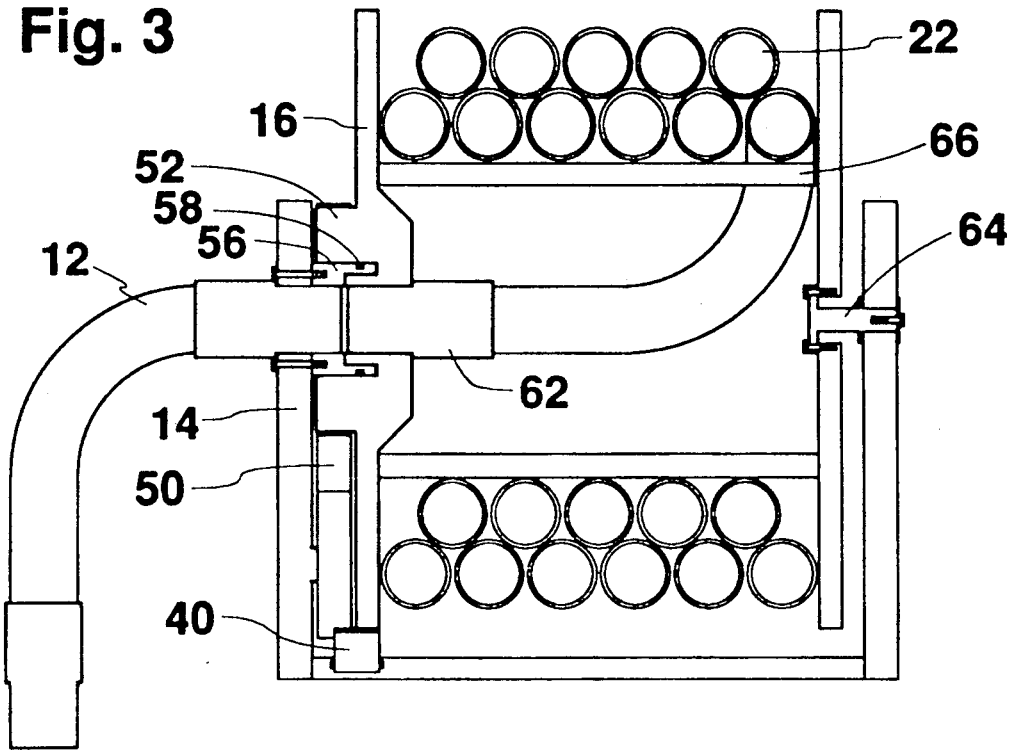
FIG. 3 is a front elevation cross sectional view through the center of the apparatus of FIG. 1.

FIG. 3 is a cross sectional front elevation view with most of the ratchet mechanism parts omitted to improve clarity. The diagram depicts the rotary coupling 56 which is fixed to the chassis. The O ring 58 provides the vacuum seal between the rotary coupling 56 and the reel 16 which is formed around the coupling. The output drum 52 is an integral part of the reel 16 in the disclosed embodiment.

The vacuum hose end coupling 62 plugs into the center of reel 16. Vacuum hose 22 runs the length of the inner reel drum cavity and then bends out and around onto the ribs 66 of the reel 16. The apparatus is shown with the vacuum hose 22 fully retracted onto two tight layers on the reel 16. Alternatively, a single layer version of the apparatus is contemplated for shorter hoses in less confined spaces. The wire rope spool 64 is firmly attached to the reel 16 and acts as an axle for rotation supported by the chassis 14.

Figure 4:
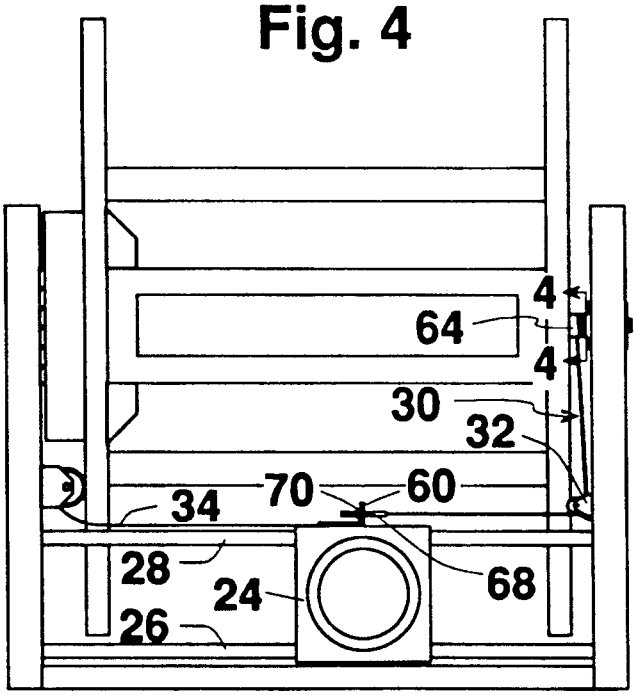
FIG. 4 is a front elevational view of select portions of the apparatus of FIG. 1.

FIG. 4 is a front elevational view with the vacuum hose, retraction spring, and ratchet mechanism omitted for clarity. One end of the constant force flat spring 34 is attached to the hose guide block 24 by means of an angle bracket 60. The constant force flat spring 34 pulls on the hose guide block 24 with a constant biasing force of approximately five pounds. The angle bracket 60 also connects one end of the rope assembly 30 to the hose guide block 24. This end of the rope assembly 30 is fitted with a threaded plug 68 and a nut 70 to allow positioning adjustments to be made. The rope assembly 30 passes through pulley 32 which directs the cable around the rim of the reel 16 and toward the cable spool 64.

Figure 5:
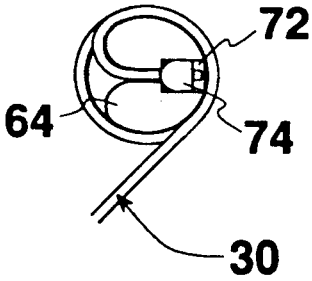
FIG. 5 is a side elevation view in section on the line A—A of FIG. 4.

Referring now to FIG. 5 which is a cross section through the rope spool 64, the rope passes through a hole 72 in the spool and is fitted with an end plug 74. The bottom of the hole 72 is step tapered in order to recess the end plug 74 into the rope spool 64. The end plug 74 prevents the rope assembly 30 from pulling through the hole 72 when the rope assembly 30 is under tension. The top of the hole 72 is radiused in the plane of the FIG. 5 view only, to minimize the concentration of stress on the rope assembly 30 as it begins to wind onto either side of the rope spool 64. The drum diameter of the rope spool 64 is chosen so that each full turn of the reel 16 draws the amount of rope onto or off of the rope spool 64 necessary to move the hose guide block 24 a diameter width of the vacuum hose 22.

The disclosed embodiment depicts a reel 16 that is six hose diameters wide. The hose guide mechanism is set up so that when the hose reel 16 is completely full, there will be six turns of rope on the rope spool 64, and the hose guide block 24 attached to the other end of the rope is located at the extreme end of the reel nearest the spool. When all six turns of rope have been unwound from the spool, the hose guide block 24 is at the far end of the reel. As the vacuum hose 22 continues to be drawn off the reel, (now working on the layer of hose closest to the reel drum surface), the rope spool 64 begins to wind the rope onto the spool, and thus draws the hose guide block 24 back towards the spool. When the hose guide block 24 reaches the spool end of the reel again, six turns of rope have been wound onto the spool and all of the vacuum hose 22 has been wound off the reel 16. The mechanism works the very same way in reverse as the retraction spring 50 is allowed to pull vacuum hose 22 back onto the reel 16.

What is claimed is:

1. A vacuum hose storage and access apparatus comprising:

(a) a structural chassis upon which the components of the said apparatus are mounted;

(b) a reel mounted for rotation on said chassis for the purpose of receiving vacuum hose;

(c) a disengageable source of retraction torque applied to said reel in the direction of winding vacuum hose onto said reel;

(d) a hose guide mechanism that guides hose onto said reel in an efficient pattern of two tight spiral wound layers of hose using a hose guide block which travels on hose guide rails running parallel to the axis of rotation of said reel, the hose passes through said hose guide block, a biasing force acting on the hose guide block in one direction, a non-elastic flexible rope assembly acting on the hose guide block in the opposite direction and controlling the position of said hose guide block along said hose guide rails, one end of said rope assembly being wound onto and off of a spool that communicates with and rotates in synchronization with said reel, said rope being wound off of said spool while the first layer of hose is being guided onto said reel, said spool being empty when the first layer of hose is substantially full, said rope being wound back onto said spool as the second layer of hose is guided onto said reel.

2. The invention according to claim 1 wherein said retraction torque is provided by a parallel drum spring located on one side of the apparatus between the chassis and the reel.

3. The invention according to claim 1 wherein the retraction torque disengagement is accomplished using a ratchet mechanism that, when engaged, allows said reel to turn substantially in only one direction, that of unwinding hose from said reel.

4. The invention according to claim 1 and further including:

(a) a connecting conduit for attaching a source of vacuum to one side of the apparatus at the axis of rotation of said reel;

(b) a sealed rotary coupling along the axis of rotation of said reel that maintains the integrity of the vacuum through to the inside cavity of the reel drum.

5. The invention according to claim 4 and further including a vacuum hose having an outlet end connected to said sealed rotary coupling within said reel drum cavity, said vacuum hose emerging from said reel drum cavity to be wound onto and off of said reel, and the inlet end of said vacuum hose available for use with vacuum cleaning attachments.

6. The invention according to claim 1 wherein said spool is an integral part of one axle of said reel and said rope is directed around one rim of said reel by a pulley, and passes through a hole in said spool, the diameter of the drum of said spool is chosen so that one rotation of said reel and said spool will wind or unwind a length of rope approximately equal to the diameter of the vacuum hose the apparatus will operate with.

* * * * *